US005269563A

United States Patent [19]

Michlin

[11] Patent Number: 5,269,563

[45] Date of Patent: * Dec. 14, 1993

[54] PERIODICAL INSERT

[75] Inventor: Irving R. Michlin, Katonah, N.Y.

[73] Assignee: Transkrit Corporation, Brewster, N.Y.

[ * ] Notice: The portion of the term of this patent subsequent to Aug. 25, 2009 has been disclaimed.

[21] Appl. No.: 874,602

[22] Filed: Apr. 27, 1992

Related U.S. Application Data

[62] Division of Ser. No. 611,178, Nov. 8, 1990, Pat. No. 5,141,252.

[51] Int. Cl.[5] ..... B42D 1/00

[52] U.S. Cl. ..... 281/15.1; 281/38; 283/56; 283/116; 224/68 R

[58] Field of Search ..... 283/56, 116, 51; 281/15.1; 229/68 R, 70, 72, 73, 301

[56] References Cited

U.S. PATENT DOCUMENTS

| | | | |
|---|---|---|---|
| 4,313,557 | 2/1982 | Foffel | 283/116 X |
| 4,485,962 | 12/1984 | Farley | 283/116 X |
| 4,520,958 | 6/1985 | Jones et al. | 283/116 X |
| 4,566,720 | 1/1986 | Goldman et al. | 283/116 X |
| 5,141,252 | 8/1992 | Michlin | 281/15.1 |

*Primary Examiner*—Mark Rosenbaum
*Assistant Examiner*—William Fridie, Jr.
*Attorney, Agent, or Firm*—Francis C. Hand

[57] ABSTRACT

A magazine is provided with an insert which can be utilized as a return mailer. The insert can be stapled or glued in place when the plies of the magazine are assembled together and includes a multi-ply portion in another part of the magazine. The multi-ply portion has a pocket which contains one or more inserts and has a flap which can close over the pocket so that, when removed, the multi-ply portion can be used as a return mailer.

9 Claims, 1 Drawing Sheet

PERIODICAL INSERT

This is a Division of application Ser. No. 07/611,178 filed Nov. 8, 1990, now U.S. Pat. No. 5,141,252.

This invention relates to a periodical insert. More particularly, this invention relates to a return mail envelope insert for a magazine, newspaper, tabloid and the like.

As is known, periodicals, such as magazines, have been provided with various types of inserts for conveying information and for direct marketing purposes. For example, it has been known to provide single ply inserts in a magazine which can be removed and mailed to a publisher, for example for ordering a subscription. Other types of inserts have also been known wherein an insert can be inserted between two pages of a magazine by being stapled in place in order to provide a return mail envelope. For example, such an insert may be made of the single ply of paper or the like which is folded over and sealed in various portions to form a return mailer and to provide folded portions containing marketing indicia.

It is an object of the invention to provide a periodical with an insert of relatively simple construction which has one or more insert plies and which can be used for return mail purposes.

It is another object of the invention to provide an insert for a periodical which can be readily incorporated into the periodical for return mail purposes.

Briefly, the invention is directed to a periodical having a plurality of pages and an insert which is disposed between two of the pages of the periodical. The insert is of multi-ply construction with a back ply, a front ply disposed over the back ply to define a pocket and at least one insert ply in the pocket.

The construction of the insert is such that the multi-ply portion can be used as a return mailer. For example, the back ply can be provided with a flap portion at one end or side for folding over the front ply in order to close the pocket. For example, where the front and back plies are disposed to form a pocket opening to the side, the flap on the back ply is sized so as to fold over the side of the front ply to close the pocket. Alternatively, the front and back plies may be secured together so as to form a pocket which is opened along the upper edge of the insert. In this case, the flap of the back ply would extend downwardly over the front ply to seal the pocket. In other cases, one or more inserts may be provided within the pocket and may extend slightly out of the pocket in order to be manually grasped and removed.

In another embodiment, the insert may have a second portion which acts as a tail and which extends to between other pages of the periodical. In this case, the periodical may have a plurality of plies disposed in folded over relation with means for securing the plies together along a central plane. Also, the insert is disposed across and between the plies in sandwiched relation. The construction of the insert is such that the two portions extend across the center plane of the magazine and are secured in place when the magazine plies are secured in place. This simplifies the assemblage of the magazine with the insert.

In order to enhance removal of the multi-ply portion of the insert from the magazine, the two portions of the insert may be separated by perforations or the like.

In order to enhance the markability of the insert, the single ply portion may be provided with graphic indicia related to the location of the multi-ply portion in the magazine. Typically, the insert would be placed in the magazine so that the multi-ply return mail portion is within the first half of the magazine while the second portion functions as a tail in a second half of the magazine. The graphic indicia may provide instructions for drawing a reader's attention again to the multi-ply portion in the first part of the magazine.

These and other objects and advantages of the invention will become more apparent from the following detailed description taken in conjunction, with the accompanying drawings wherein.

Figure 1:
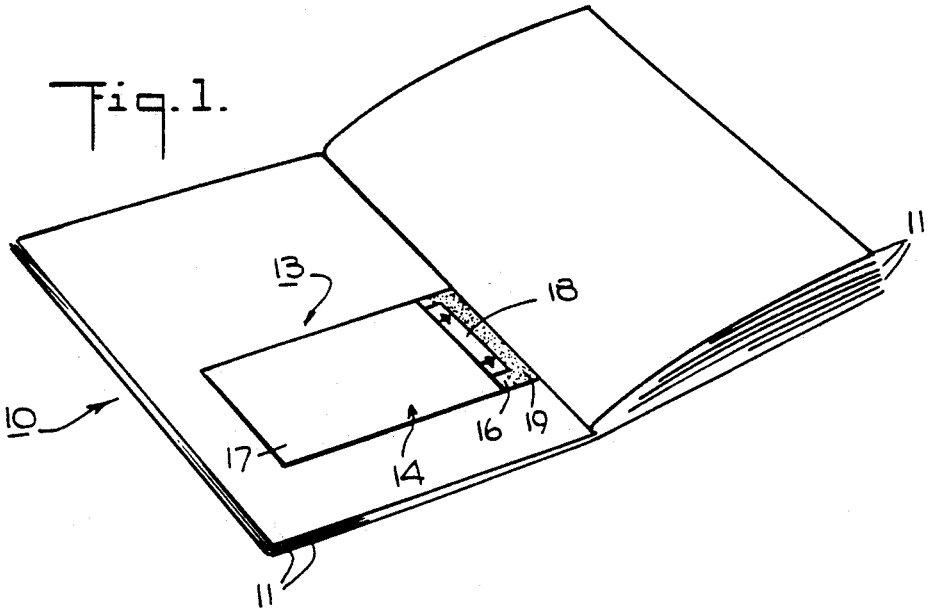
FIG. 1 illustrates a perspective view of a magazine having an insert therein in accordance with the invention.

Referring to FIG. 1, the magazine 10 is of generally conventional structure and has a plurality of plies 11 which are disposed in folded over relation with means, such as staples 12 (see FIG. 2), for securing the plies together along a center plane. As indicated, each ply 11 extends across the entire width of the magazine 10 and is folded in half to form four pages of the magazine as is known.

The insert 13 is disposed in the magazine 10 by being sandwiched between two of the magazine plies 11. As indicated in FIG. 2, the insert 13 has a multi-ply portion 14 on one side of the center plane of the magazine and a single ply portion 15 on the opposite side of the center plane of the magazine.

The multi-ply portion 14 includes a back ply 16 which is removably secured to the second portion 15 of the insert and to the magazine 10 via the staples 12, a front ply 17 which is secured to the back ply 16 to define a pocket therewith and at least one insert ply 18 in the pocket and which projects from the pocket. Alternatively, the front ply 17 instead of being separate from the back ply as shown in FIG 2 may be folded over the back ply 16 without being secured thereto. In this case, a single sheet is used to form the two plies 16, 17.

Figure 2:
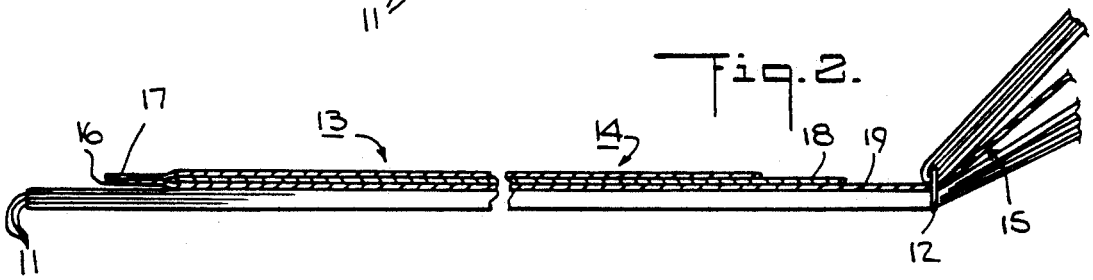
FIG. 2 illustrates a part cross-sectional view of the magazine and insert of FIG. 1.

As indicated in FIG. 2, the back ply 16 is coextensive with the single ply portion 15 of the opposite side of the magazine 10. In addition, a line of weakening, such as a line of perforations, may be provided between the back ply 16 and the single ply portion 15 to facilitate removal of the multi-ply portion 14 from the magazine 10.

As indicated in FIG. 1, the front and back plies 17, 16 are secured together so as to form a pocket which opens to the side, that is, the right-hand side, as viewed. Alternatively, the front and back plies may be secured together so as to form a pocket which opens towards the upper edge of the insert, and, thus, of the magazine. Also, the pocket may open to the left, as viewed.

Figure 3:
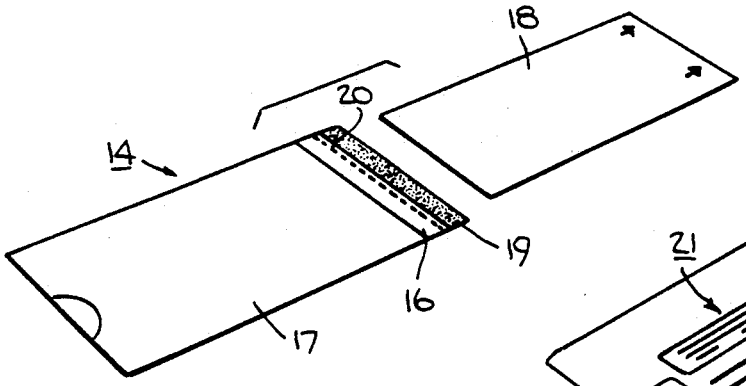
FIG. 3 illustrates an exploded view of the insert of FIG. 1.
Figure 4:
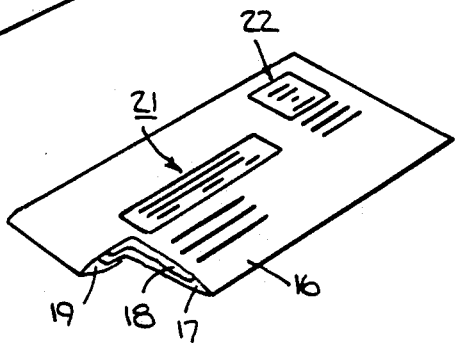
FIG. 4 illustrates the multi-ply portion of the insert when used as a return mailer.

In any event, the back ply 16 is provided with a flap portion 19 which projects beyond the insert ply 18 as well as with a line of weakening, such as a line of perforations 20 (see FIG. 3) so as to permit folding over of the flap 19 onto the face of the front ply 17 (see FIG. 4). The flap 19 may also have a suitable adhesive means thereon for securing the flap 19 to the face of the front ply 17.

As indicated in FIG. 2, the flap 19 is contiguous to the single ply portion 15 so as to be separated therefrom when the multi-ply portion 14 is removed from the magazine.

Referring to FIG. 1, the multi-ply insert 14 is constructed so as to be readily removed from the magazine 10 and employed as a return mailer. To this end, the user would simply grasp and physically remove the multi-ply portion 14 by tearing along the line of weakening separating the multi-ply portion 14 from the single ply portion 15 and the other half of the magazine. Next, the insert or inserts 18 would be removed from the pocket between the front and back plies 17, 16 (see FIG. 3). Thereafter, one or more inserts may be reinserted into the pocket and the flap 19 folded over and secured to the face of the front ply 17 (see FIG. 4).

In order to enhance use of the multi-ply insert as a mailer, the back surface of the back ply 16 can be preprinted with reply address information 21 and postal indicia 22 so as to be conveniently mailed.

The single ply portion 15 of the insert 13 may also contain graphic indicia relative to the location of the multi-ply portion 14 in the magazine 10. For example, this single ply portion 15 may be provided with graphic indicia including multiple color characteristics and an indication as to which page of the magazine contains the multi-ply return mail portion of the insert 13. In this way, a reader of the magazine would first notice the multi-ply portion 14 while reading the first half of the magazine and would subsequently be directed back to the multi-ply portion upon arriving at the page containing the single ply portion 15 or "tail" of the insert.

The insert 13 may be bound into the magazine 10 in any suitable fashion. Also, the insert 13 may be bound into other periodicals, such as newspapers, tabloids, catalogs and the like.

The insert 13 can be assembled with the pages 11 of the magazine 10 in any suitable fashion and secured in place, for example by staples 12, by stitching, or otherwise. By being inserted and secured in place when the plies 11 of the magazine 10 are assembled, there is no need for additional equipment for inserting or stuffing the insert into a magazine.

Where the insert is used without the tail portion, i.e. with only the multi-ply portion, the insert can be inserted into a periodical in any known fashion, such as by being blown in, adhesively secured in place, and so on. Further, the insert plies can be provided with graphic indicia relative to an advertisement on at least one of the two pages between which the insert is sandwiched.

The invention thus provided a periodical with a multi-ply insert which is able to supply multiple inserts plies for expansion of advertising information, and the like, to tell more of a story as well as to provide a return mailer.

What is claimed is:

1. In combination, a periodical having a plurality of pages; and an insert in said periodical, said insert being disposed between two of said pages and having a back ply, a front ply disposed on said back ply to define a pocket therewith, a plurality of insert plys in said pocket with at least one of said insert plys projecting out of said pocket and a flap on one of said back ply and said front ply for closing said pocket to form a return mailer.

2. The combination according to claim 1 wherein said back ply has said flap for folding over said front ply to close said pocket and adhesive means on one of said flap and said front ply for securing said flap to said front ply.

3. The combination according to claim 1 wherein said inserts plys project out of said pocket beyond said front ply and said flap is on said back ply.

4. The combination as set forth in claim 3 wherein one of said back ply and said front ply has preprinted reply address information thereon.

5. The combination as set forth in claim 1 whereon said back ply is removably secured to one of said pages.

6. In combination, a periodical having a plurality of pages; and an insert in said periodical, said insert being disposed between two of said pages and having a back ply, a front ply disposed on said back ply to define an open pocket therewith, a plurality of insert plys in said pocket and projecting from said pocket and a flap on one of said back ply and said front ply for closing said pocket to form a return mailer, said flap projecting beyond said projecting insert plys.

7. The combination according to claim 6 wherein said back ply has said flap extending therefrom for folding over said front ply to close said pocket after an initial removal of said inserts and adhesive means on one of said flap and said front ply for securing said flap to said front ply.

8. The combination as set forth in claim 7 wherein one of said back ply and said front ply has preprinted reply address information thereon.

9. The combination as set forth in claim 7 wherein said back ply is removably secured to one of said two pages.

* * * * *